US007287602B2

(12) United States Patent
Zeiter et al.

(10) Patent No.: US 7,287,602 B2
(45) Date of Patent: Oct. 30, 2007

(54) SPINDLE LOCK FOR ROTARY POWER TOOL

(75) Inventors: Olivier Zeiter, Biberist (CH); Bruno Aeberhard, Studen (CH); Beat Salzgeber, Visp (CH)

(73) Assignee: Robert Bosch GmbH, Stuttgart (DE)

( * ) Notice: Subject to any disclaimer, the term of this patent is extended or adjusted under 35 U.S.C. 154(b) by 52 days.

(21) Appl. No.: 11/273,423

(22) Filed: Nov. 14, 2005

(65) Prior Publication Data

US 2006/0131127 A1 Jun. 22, 2006

(30) Foreign Application Priority Data

Nov. 18, 2004 (DE) ..... 10 2004 055 572

(51) Int. Cl.
*B25B 21/00* (2006.01)
*B25F 5/00* (2006.01)

(52) U.S. Cl. ..... 173/213; 173/217; 173/164

(58) Field of Classification Search ..... 173/213, 173/217, 165, 164, 176, 178
See application file for complete search history.

(56) References Cited

U.S. PATENT DOCUMENTS 4,597,453 A * 7/1986 Kilmer et al. ..... 173/171
5,788,021 A 8/1998 Tsai
5,947,210 A * 9/1999 Sasaki et al. ..... 173/178
5,954,144 A * 9/1999 Thames ..... 173/216
5,984,022 A * 11/1999 Harman et al. ..... 173/176
6,688,406 B1 * 2/2004 Wu et al. ..... 173/48
6,929,074 B1 * 8/2005 Lai ..... 173/178
2002/0153147 A1 * 10/2002 Mamber et al. ..... 173/132
2006/0131043 A1 * 6/2006 Zeiter ..... 173/216

FOREIGN PATENT DOCUMENTS

DE 101 48 872 A1 4/2003
EP 1 240 983 9/2002
EP 1 410 879 4/2004
GB 2 392 403 3/2004
JP 05269677 10/1993
JP 05293769 11/1993

* cited by examiner

*Primary Examiner*—Brian D. Nash
(74) *Attorney, Agent, or Firm*—Michael J. Striker

(57) ABSTRACT

A slaving and blocking device for transmitting a torque from a driving part to a driven part and for stopping the driven part at a torque engaging the driven part has a slaving element fixable on the driving part and having slaving claws offset from one another in a circumferential direction, a roller star wheel connectable to the driven part and having points of a star offset from one another in the circumferential direction, and a stationary clamping ring located concentrically with the slaving element and the roller star wheel. A contact face on the points of the star is configured so that the clamping rollers, which when the slaving element is driven are pressed by the slaving claws against contact faces of the points of the star, are thrust inwards. The slaving faces on the slaving claws are configured such that when the slaving element is driven, they load the clamping rollers with a pressure force such that a tangential force component of the pressure force is substantially greater than a radial force component of the pressure force.

11 Claims, 3 Drawing Sheets

SPINDLE LOCK FOR ROTARY POWER TOOL

CROSS-REFERENCE

The invention described and claimed hereinbelow is also described in DE 10 2004 055572.9, filed Nov. 18, 2004. This German Patent Application, whose subject matter is incorporated here by reference, provides the basis for a claim of priority of invention under 35 U.S.C. 119 (a)-(d).

BACKGROUND OF THE INVENTION

The invention is based on a slaving and blocking device for transmitting a torque from a driving part to a driven part and for stopping the driven part at a torque engaging the driven part, and in particular on a spindle block for a hand power tool with a rotating tool bit.

A slaving and blocking device of this kind is used as a so-called spindle block or automatic spindle lock in hand power tools, especially power drills or power screwdrivers, so that upon engagement of the tool bit with a workpiece, if there is a simultaneous failure of the energy supply, the hand power tool can be rotated with the tool bit so that the tool bit can be disengaged from its engagement with the workpiece, and also so that a single-sleeve drill chuck can be clamped and released.

A known spindle block (German Patent Disclosure DE 101 48 872 A1) includes a slaving means, connected in a manner fixed against relative rotation to the driving gear wheel for the spindle that carries the tool bit, with three slaving claws, offset from one another by the same circumferential angle; one roller star wheel, connected to the spindle in a manner fixed against relative rotation, with three radially extending points of the star, offset from one another by the same circumferential angle in the circumferential direction; one clamping ring, concentric with the slaving means and the roller star wheel, which is fixed nonrotatably in the housing of the hand power tool; and six clamping rollers. The slaving means receives the roller star wheel in such a way that in the circumferential direction, the slaving claws and the points of the star are located in alternation one behind each other and spaced apart from one another.

The six clamping rollers are each placed in the free space, defined on the outside by the inner annular face of the clamping ring, between the slaving claws and the points of the star. If the driving gear wheel is motor-driven, then—regardless of its direction of rotation—three of the six clamping rollers at a time are pressed by the slaving claws against contact faces, extending radially, of the points of the star, and the torque of the driving gear wheel is thus transmitted via the slaving means, the clamping rollers and the rotor star onto the spindle and thus onto the tool bit held in a tool bit receptacle on the spindle. Conversely, if a driving torque is exerted on the spindle by the tool bit, then because of the rotation of the roller star wheel relative to the slaving means, three at a time of the total of six clamping rollers are displaced—again regardless of the direction of rotation—against clamping faces embodied on the points of the star and clamp firmly against the inner annular face, forming a counterpart clamping face, of the clamping ring. The entire torque is output to the clamping ring that is firmly connected to the housing and is not transmitted to the slaving means.

SUMMARY OF THE INVENTION

It is therefore an object of the present invention to provide a slaving and blocking device, which is a further improvement of the existing devices.

In keeping with these objects and with others which will become apparent hereinafter, one feature of the present invention resides, briefly stated in a slaving and blocking device for transmitting a torque from a driving part to a driven part and for stopping the driven part at a torque engaging the driven part, the device comprising a slaving means fixable on the driving part in a manner fixed against relative rotation and having slaving claws, offset from one another in a circumferential direction, with slaving faces provided on sides facing away from each other and pointing in the circumferential direction; a roller star wheel connectable to the driven part in a manner fixed against relative rotation and having points of a star, offset from one another in the circumferential direction, with contact and clamping faces embodied on sides facing away from one another; clamping rollers located in freewheeling fashion in the circumferential direction between said slaving claws and said points of said star; a stationary clamping ring located concentrically with said slaving means and said roller star wheel and having an inner annular face forming a counterpart clamping face for said clamping rollers, said contact face on said points of said star being configured so that said clamping rollers, which when said slaving means is driven are pressed by said slaving claws against said contact faces of said points of said star, are thrust inwards, and said slaving faces on said slaving claws are configured such that when said slaving means is driven, they load said clamping rollers with a pressure force such that a tangential force component of the pressure force is substantially greater than a radial force component of the pressure force.

The slaving and blocking device of the invention, in particular a spindle block, has the advantage that without altering the spatial conditions in the apparatus, the described optimization of the design of the slaving claws and points of the star attains improved function and greater torque transmission, without the risk of deforming the slaving claws. The pressure forces that are exerted, upon the rotary slaving of the roller star wheel, by the driven slaving means on the elements that are meshing with one another are directed in the direction of the greater moment of inertia of the slaving claws, so that the deformation of the slaving claws remains negligibly slight.

In an advantageous embodiment of the invention, the contact faces, clamping faces and slaving faces are embodied as hollow curvatures, such that the Hertzian stress between the contact, clamping and slaving faces on the one hand and the clamping rollers on the other is minimized. Simultaneously, by the dimensioning of the hollow curvatures, the clamping angle of the clamping faces is adjusted such that the clamping rollers, which clamp firmly on the clamping ring between the clamping faces and the counterpart clamping face when the roller star wheel is driven, slip through if the maximum allowable Hertzian stress is exceeded. This provision prevents plastic deformation and damage to the device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
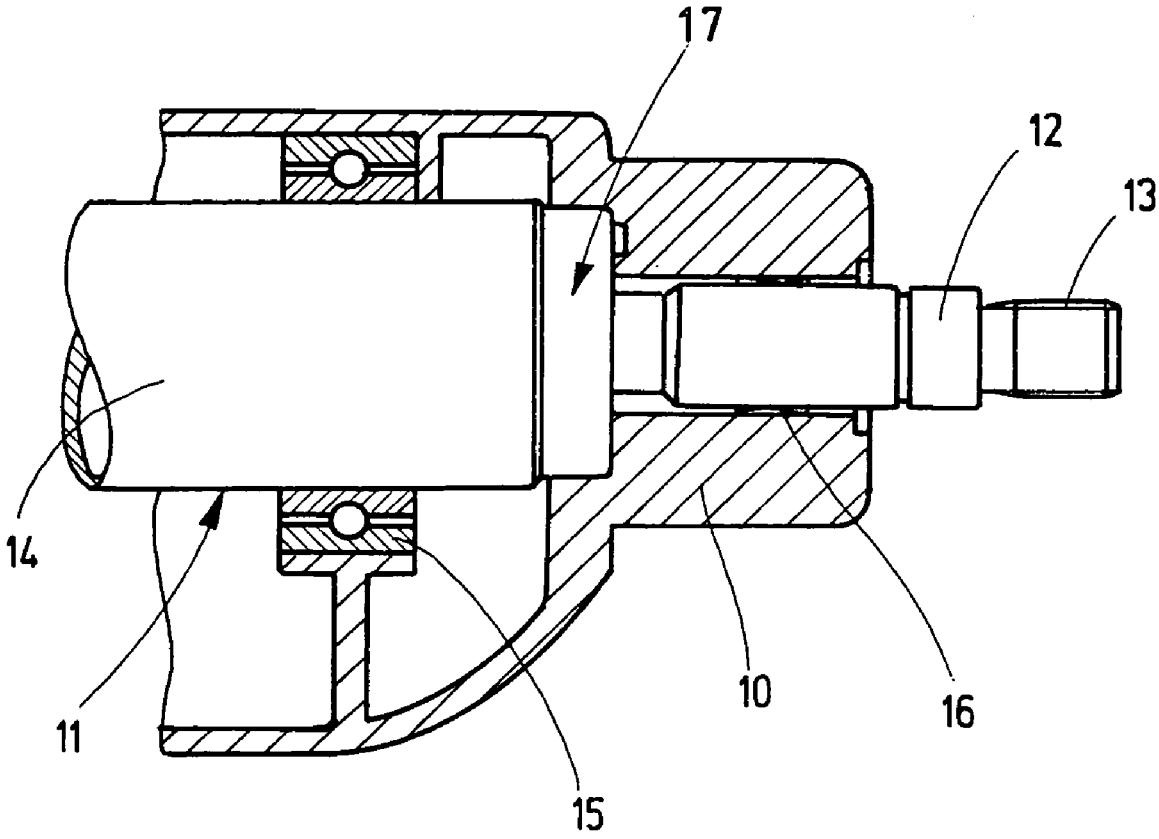
FIG. 1 is a fragmentary longitudinal section of a hand power tool with a spindle, spindle block, and motor rotary drive for the spindle block and the spindle.

The hand power tool schematically shown in FIG. 1 in fragmentary longitudinal section is embodied as a power drill or power screwdriver. It has a housing 10, a motor rotary drive 11 received in the housing 10, and a spindle 12, which is rotatably supported in the housing 10 by means of a needle roller bearing 16 and protrudes axially out of the housing 10 and on its end has a male, thread 13 for screwing on a clamping chuck for a drill or screwdriver. Of the motor rotary drive 11, only a hollow shaft 14 is shown, which is supported in a ball bearing 15 in the housing 10. The hollow shaft 14 is driven to rotate by an electric motor via a gear. The spindle 12 is coupled to the hollow shaft 14 via a spindle block 17.

Figure 2:
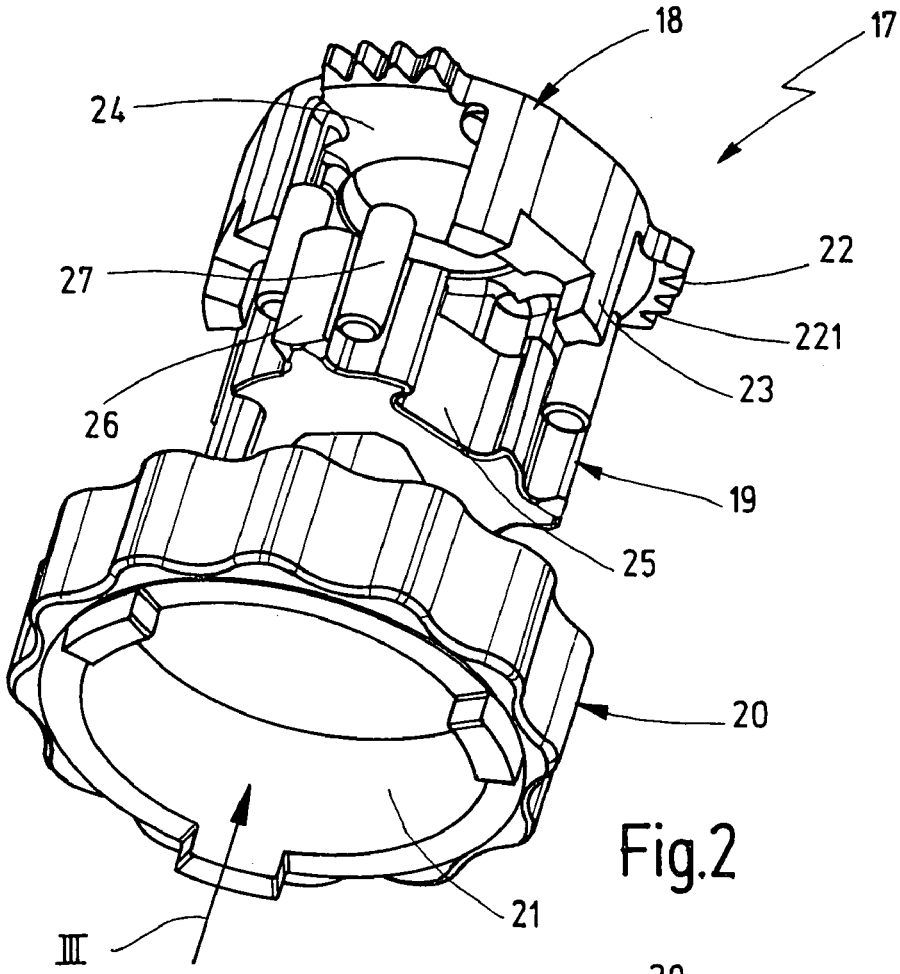
FIG. 2 is an exploded view of the spindle block in FIG. 1 with the slaving means, roller star wheel and clamping ring.
Figure 3:
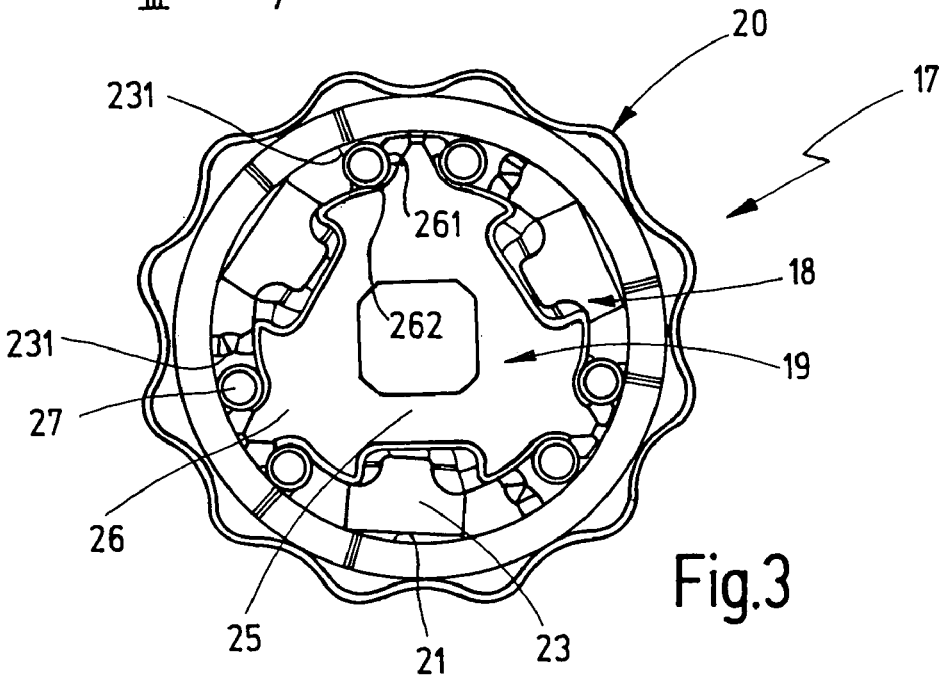
FIG. 3 is a view of the spindle block in the direction of arrow III in FIG. 2.

The spindle block 17 shown in FIG. 2 in an exploded view and in FIG. 3 in an end view in put-together form is a slaving and blocking device, which on the one hand transmits a torque from a driving part, which in this exemplary embodiment is formed by the hollow shaft 14, to a driven part, which in this exemplary embodiment is formed by the spindle 12, and on the other, at a torque that engages the driven part, in this exemplary embodiment the spindle 12, stops the driven part, in this example the spindle 12, on the housing 10 by clamping. To that end, the spindle block 17 has a slaving means 18 that can be fixed on the driving part, a roller star wheel 19 which is placed in the slaving means 18 and can be connected to the driven part in a manner fixed against relative rotation, and a clamping ring 20, located concentrically with the slaving means 18 and roller star wheel 19 and connected to the housing 10 in a manner fixed against relative rotation, the inner annular face of the clamping ring forming a counterpart clamping face 21 for clamping rollers 27 to be described in further detail below.

Figure 4:
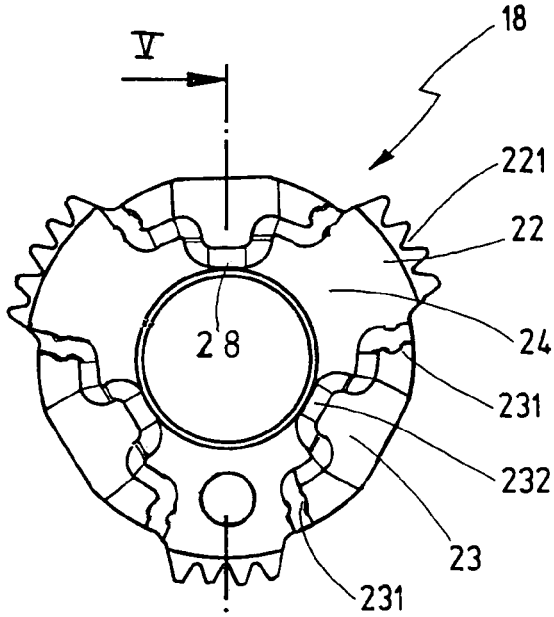
FIG. 4 is a plan view on the slaving means of the spindle block in FIG. 2.
Figure 5:
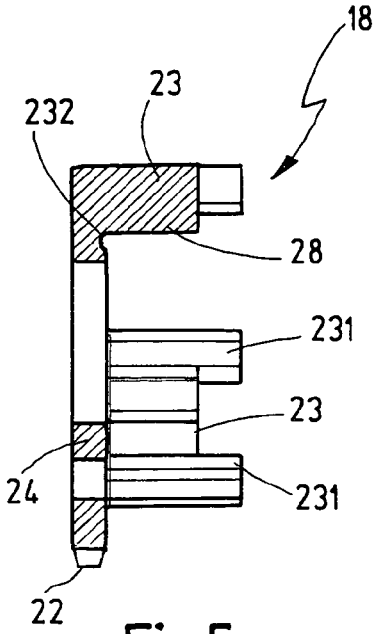
FIG. 5 is a section taken along the line V-V in FIG. 4.

The slaving means 18 (FIGS. 4 and 5) has a disk-shaped slaving body 24, from which slaving claws 23, embodied in one piece with it and offset from one another by equal circumferential angles, protrude axially. In the exemplary embodiment, three slaving claws 23 are provided. Toothed segments 22 protrude radially from the slaving body 24 and are offset from one another by the same circumferential angle on the slaving body 24 and are in one piece with it. In the exemplary embodiment, once again three toothed segments 22 are provided, which are located in the region between the slaving claws 23. The toothed segments 22 have external sets of teeth 221, which mesh with an internal set of teeth that is embodied all the way around in the end portion of the hollow shaft 14 that fits over the slaving body 24. A slaving face 231 for the clamping rollers 27 that points in the circumferential direction is embodied, on sides facing from each other, on each slaving claw 24.

Figure 6:
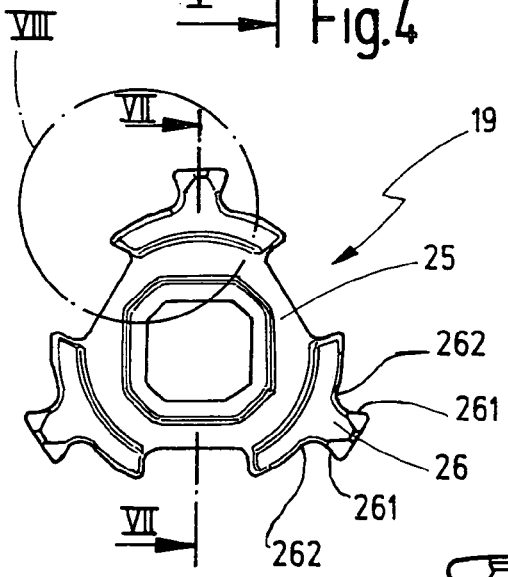
FIG. 6 is a plan view on the roller star wheel of the spindle block in FIG. 2.
Figure 7:
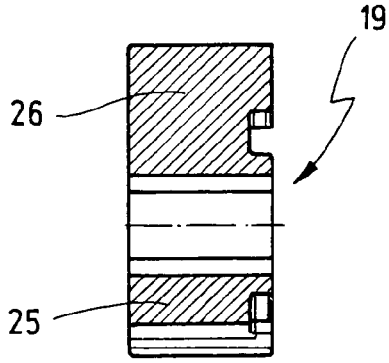
FIG. 7 is a section taken along the line VII-VII in FIG. 6.

The roller star wheel 19 (FIGS. 6 and 7) has a central star body 25, on which three radially protruding points 26 of the star are shaped in one piece. The total of three points 26 of the star in this exemplary embodiment are offset from one another by equal circumferential angles, so that the offset angle corresponds to that of the slaving claws 23 on the slaving means 18. The roller star wheel 19 is inserted into the slaving means 18 such that in alternation, again and again, one after the other in the circumferential direction there are a slaving claw 23 and a point 26 of the star, which are spaced apart from one another in the circumferential direction (FIG. 3). The points 26 of the star are embodied such that in the radial direction they end with gap spacing in front of the counterpart clamping face 21 of the clamping ring 20.

Figure 8:
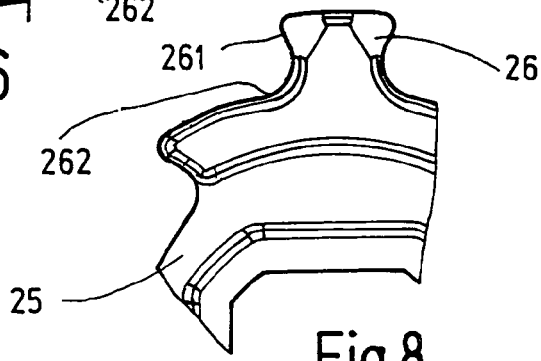
FIG. 8 is an enlarged view of the detail marked VIII in FIG. 6.

On sides facing away from each other, one contact face 261 and a clamping face 262 adjoining it for a clamping roller 27 are embodied on each point of the star (FIG. 8). In each free space formed between one slaving claw 23 and one point 26 of the star, which space is defined on the outside by the counterpart clamping face 21 of the clamping ring 20, one of the total of six clamping rollers 27 is placed (FIG. 3). When the slaving means 18 is driven via the hollow shaft 14, the slaving faces 231 of the slaving claws 23, each pointing in the direction of rotation, press against the clamping rollers 27 and displace them against the contact faces 261 of the points 26 of the star. The remaining clamping rollers 27 press against the other contact faces 261 of the points 26 of the star. Regardless of the direction of rotation of the slaving means 18, the torque is transmitted, via the slaving claws 23, the clamping rollers 27, and the points 26 of the star, to the roller star wheel 19 and thus to the spindle 12 that is firmly connected to the roller star wheel 19. The tool bit fastened in the tool bit receptacle of the spindle 12 rotates.

Conversely, if a driving torque is exerted on the spindle block 17 by the tool bit via the spindle 12, or in other words the roller star wheel 19 is driven, then three clamping rollers 27 of the total of six clamping rollers 27 press against the clamping faces 262 of the points 26 of the star and press themselves firmly between the clamping faces 262 and the counterpart clamping face 21 on the stationary clamping ring 20. The entire torque is thus braked at the clamping ring 20 connected to the housing 10 and is not transmitted to the slaving means 18.

To attain a reliable function of the spindle block 17 with the least installation space being required and with high torque transmission, a plurality of optimizing provisions are made in terms of designing the slaving faces 231 on the slaving claws 23 and designing the contact faces 261 and clamping faces 262 on the points 26 of the star. One of the optimizing provisions is embodying the contact faces 261 such that the clamping rollers 27, which when the slaving means 18 is driven are pressed by the slaving claws 23 against the contact faces 261 are thrust inward, away from the counterpart clamping face 21, and hence contact with the counterpart clamping face 21 is thus reliably avoided.

The slaving faces 231 on the slaving claws 23 are designed such that when the slaving means 18 is driven they load the clamping rollers 27 with a pressure force, which points in the direction of the greater moment of inertia of the slaving claws 23, as a result of which the tangential force components of the pressure forces acting on the slaving claws 23 are substantially greater than the radial force components of the pressure forces. As a result, any deformation of the slaving claws 23 upon the transmission of high torques remains minimal. In addition, on each slaving claw 23, on its inward-pointing side, an axially extending reinforcing rib 28 (FIG. 5) is located in the middle, to increase the lesser moment of inertia of the slaving claw 23. The root 232 of each slaving claw 23 (FIG. 5) is rounded, and the greatest possible rounding radius is employed.

Both the slaving faces 231 and the contact faces 261 and clamping faces 262 on the points 26 of the star are embodied as hollow curvatures, that is, concave, in order to minimize the Hertzian stress between the clamping rollers 27 and the slaving claws 23 on the one hand and between the clamping rollers 27 and the points 26 of the star on the other. With the dimensioning of the hollow curvatures of the contact faces 261, the clamping angle of the clamping faces 262 is also adjusted such that the clamping rollers 27, which when the roller star wheel 19 is driven clamp themselves firmly between the clamping faces 262 and the counterpart clamping face 21, slip through when the maximum allowable Hertzian stress is exceeded. This prevents a plastic deformation that over the long term would lead to damage to the spindle block 17.

It will be understood that each of the elements described above, or two or more together, may also find a useful application in other types of constructions differing from the types described above.

While the invention has been illustrated and described as embodied in, it is not intended to be limited to the details shown, since various modifications and structural changes may be made without departing in any way from the spirit of the present invention.

Without further analysis, the foregoing will reveal fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A slaving and blocking device for transmitting a torque from a driving part to a driven part and for stopping the driven part at a torque engaging the driven part, the device comprising a slaving means fixable on the driving part in a manner fixed against relative rotation and having slaving claws, offset from one another in a circumferential direction, with slaving faces provided on sides facing away from each other and pointing in the circumferential direction; a roller star wheel connectable to the driven part in a manner fixed against relative rotation and having points of a star, offset from one another in the circumferential direction, with contact and clamping faces embodied on sides facing away from one another; clamping rollers located in freewheeling fashion in the circumferential direction between said slaving claws and said points of said star; a stationary clamping ring located concentrically with said slaving means and said roller star wheel and having inner annular face forming a counterpart clamping face for said clamping rollers, said contact face on said points of said star being configured so that said clamping rollers, which when said slaving mean is driven are pressed by said slaving claws against said contact faces of said points of said star, are thrust inwards, and said slaving faces on said slaving claws are configured such that when said slaving means is driven, they load said clamping rollers with a pressure force such that a tangential force component of the pressure force is substantially greater than a radial force component of the pressure force, wherein said contact faces and said clamping faces on said points of said star and said slaving faces on said slaving claws are configured as hollow curvatures, such that a Hertzian stress between said contact, clamping and slaving faces on one hand and said clamping rollers on another hand is minimized.

2. A slaving and blocking device as defined in claim 1, wherein a clamping angle of said clamping faces on said points of said star is adjustable, such that said clamping rollers, which are stopped between said clamping faces and said counterpart clamping face when said roller star wheel is driven are adapted to slip through if a maximum allowable Hertzian stress is exceeded.

3. A slaving and blocking device as defined in claim 1, wherein said slaving means have a disk-shaped slaving body, from which said slaving claws axially protrude, and on each slaving claw one axially extending reinforcing rib is located centrally.

4. A slaving and blocking device as defined in claim 3, wherein said slaving claws axially protrude from said disk-shaped slaving body in one piece with the latter.

5. A slaving and blocking device as defined in claim 3, wherein said one axially extending reinforcing rib is located centrally and in one piece with said slaving claw.

6. A slaving and blocking device as defined in claim 3, wherein said reinforcing ribs are configured and positioned on the slaving claws so that a lesser moment of inertia of said slaving claws is increasable.

7. A slaving and blocking device as defined in claim 1, wherein said slaving claws have roots which are rounded with a radius that is as large as possible.

8. A slaving and blocking device as defined in claim 1, wherein the slaving and blocking device is formed as a spindle block for hand power tools with a rotating tool bit.

9. A hand power tool, comprising a tool bit; a spindle that carries said tool bit; an electric motor rotary drive for rotationally driving said spindle that carries said tool bit; and a slaving and a blocking device located between said rotary drive and said spindle, said slaving and blocking device including a slaving means fixable on the driving part in a manner fixed against relative rotation and having slaving claws, offset from one another in a circumferential direction, with slaving faces provided on sides facing away from each other and pointing in the circumferential direction; a roller star wheel connectable to the driven part in a manner fixed against relative rotation and having points of a star, offset from one another in the circumferential direction, with contact and clamping faces embodied on sides facing away from one another; clamping rollers located in freewheeling fashion in the circumferential direction between said slaving claws and said points of said star; a stationary clamping ring located concentrically with said slaving means and said roller star wheel and having inner annular face forming a counterpart clamping face for said clamping rollers, said contact face on said points of said star being configured so that said clamping rollers, which when said slaving mean is driven are pressed by said slaving claws against said contact faces of said points of said star, are thrust inwards, and said slaving faces on said slaving claws are configured such that when said slaving means is driven, they load said clamping rollers with a pressure force such that a tangential force component of the pressure force is substantially greater than a radial force component of the pressure force, wherein said contact faces and said clamping faces on said points of said star and said slaving faces on said slaving claws are configured as hollow curvatures.

10. A hand power tool as defined in claim 9, wherein the hand power tool is configured as a power drill.

11. A hand power tool as defined in claim 9, wherein the hand power tool is configured as a power screwdriver.

* * * * *